US011230834B2

(12) United States Patent
Stammel

(10) Patent No.: US 11,230,834 B2
(45) Date of Patent: Jan. 25, 2022

(54) SANITARY FIXTURE IN THE FORM OF A WATER CLOSET

(71) Applicant: Duravit Aktiengesellschaft, Hornberg (DE)

(72) Inventor: Thomas Stammel, Hornberg (DE)

(73) Assignee: DURAVIT AKTIENGESELLSCHAFT, Hornberg (DE)

( * ) Notice: Subject to any disclaimer, the term of this patent is extended or adjusted under 35 U.S.C. 154(b) by 100 days.

(21) Appl. No.: 16/776,983

(22) Filed: Jan. 30, 2020

(65) Prior Publication Data

US 2020/0284016 A1 Sep. 10, 2020

(30) Foreign Application Priority Data

Mar. 7, 2019 (DE) ..... 10 2019 105 732.9

(51) Int. Cl.
*E03D 11/13* (2006.01)
*E03D 3/00* (2006.01)

(52) U.S. Cl.
CPC ..... *E03D 11/13* (2013.01); *E03D 3/00* (2013.01)

(58) Field of Classification Search
CPC ..... E03D 11/13; E03D 3/00
USPC ..... 4/432, 420
See application file for complete search history.

(56) References Cited

U.S. PATENT DOCUMENTS 155,814 A 10/1874 Stocktort
5,918,325 A 7/1999 Arita
5,926,863 A 7/1999 Arita
6,145,138 A 11/2000 Nakamura
6,675,399 B1 * 1/2004 Tomita ..... E03D 3/00 4/420.2
6,986,172 B2 1/2006 Hideteks
(Continued)

FOREIGN PATENT DOCUMENTS

CN 205954789 U 2/2017
CN 206245438 U 6/2017
(Continued)

OTHER PUBLICATIONS

CNIPA issued Office Action dated Feb. 2, 2021 regarding the parallel Chinese Patent Application No. 202010131249.1, 4 pages.
(Continued)

*Primary Examiner* — Tuan N Nguyen
(74) *Attorney, Agent, or Firm* — Lucas & Mercanti, LLP; Klaus P. Stoffel

(57) ABSTRACT

A sanitary fixture having a body with an upwardly open pan region. A water chamber is provided in the region of the upper rim of the pan region and, when viewed horizontally, protrudes into the pan region. At least one flushing opening oriented downwardly into the pan region is provided on the chamber side. At least one connecting portion is provided in the rear region of the body for connecting a flushing water supply pipe for supplying flushing water into the water chamber, the flushing water flowing therefrom into the pan region via the at least one flushing opening on the chamber side. The water chamber extends only in a rear rim region. At least one second flushing opening is provided oriented to the front to permit a tangential flushing of the water into the pan region and is able to be supplied with flushing water.

19 Claims, 8 Drawing Sheets

(56) References Cited

U.S. PATENT DOCUMENTS

| | | | | |
|---|---|---|---|---|
| 7,325,258 | B2 | 2/2008 | Asada | |
| 9,702,135 | B2 | 7/2017 | Kashirajima | |
| 10,145,097 | B2 | 12/2018 | McHale | |
| 2003/0115664 | A1* | 6/2003 | Kosugi | E03D 11/16 4/420 |
| 2015/0152628 | A1* | 6/2015 | Hirai | E03D 3/00 4/420 |
| 2017/0247871 | A1 | 8/2017 | Mukerji | |
| 2017/0275862 | A1 | 9/2017 | Kashirajima | |

FOREIGN PATENT DOCUMENTS

| | | | |
|---|---|---|---|
| EP | 1234921 | 81 | 8/2006 |
| EP | 3054061 | | 8/2016 |
| EP | 1847658 | B1 | 12/2016 |
| JP | 2016014316 | A | 1/2016 |
| WO | 2004020753 | A2 | 3/2004 |
| WO | 2005085538 | | 1/2008 |
| WO | 2017132175 | A1 | 8/2017 |

OTHER PUBLICATIONS

Indian Patent Office issued an Office Action dated May 28, 2021 regarding the parallel Indian Patent Application No. 202024007942, 6 pages.

German Patent and Trademark Office issued Office Action dated Jan. 30, 2020 regarding parallel Gemtan Patent Application No. 10 2019 105 732.9 including machine-generated English translation, IQ pages.

* cited by examiner

SANITARY FIXTURE IN THE FORM OF A WATER CLOSET

CROSS-REFERENCE TO RELATED APPLICATIONS

The present application claims priority of DE 10 2019 105 732.9, filed Mar. 7, 2019, the priority of this application is hereby claimed and this application is incorporated herein by reference.

BACKGROUND OF THE INVENTION

The invention relates to a sanitary fixture in the form of a WC (water closet), comprising a body having an upwardly open pan region, a water chamber which is provided in the region of the upper rim of the pan region and which, when viewed horizontally, protrudes into the pan region, wherein at least one flushing opening which is oriented downwardly into the pan region is provided on the chamber side, and at least one connecting portion is provided in the rear region of the body for connecting a flushing water supply pipe which is preferably supplied via a pressure generating apparatus, in particular a pump, for supplying flushing water into the water chamber, the flushing water flowing therefrom into the pan region via the at least one flushing opening on the chamber side.

Known WCs, whether suspended or floor-mounted WCs, often have a so-called flushing rim which is formed by a water chamber circulating around the entire region of the upper pan rim, into which water is introduced via a flushing water supply pipe connected thereto. The water is distributed in the annular water chamber, i.e. the flushing rim, from where it may exit generally via a plurality of flushing openings oriented downwardly in the pan region. The water thus flows vertically downwardly from the lower face of the circulating flushing water channel and flows along the pan surface to the outlet. By this vertical component of the flow direction of the flushing water, an effective submerging of the objects to be flushed away is achieved.

In order to flood the annular flushing water channel, respectively the relatively large water chamber, as rapidly as possible with flushing water, in modern WCs a connecting portion is provided for connecting a pressure generating apparatus, such as for example a pump, via which the flushing water is conveyed into the water chamber at significantly greater pressure compared with so-called purely gravity-fed flushing where the water flows without the assistance of a pump from a cistern or flushing cistern.

A drawback in such conventional WCs comprising a flushing rim, however, is that by the overhanging shape which is effectively oriented horizontally to the pan interior, the lower face of the flushing rim and the pan surface directly below the flushing rim are only accessible with difficulty for cleaning purposes.

In order to remedy this, WCs which dispense with a conventional peripheral flushing rim and which are frequently also called "rimless WCs" are known. Such a WC is operated with an effectively rotating, vortex-like flushing water flow, which is generally denoted as rotational flushing. The water is supplied horizontally and substantially tangentially to the pan surface via at least one water outlet opening.

Although in this case a rim, which is associated with cleaning problems, is no longer provided, due to the water flow which is introduced substantially horizontally into the pan region an effective discharge of objects to be flushed away is inadequate since a sufficiently downwardly oriented movement component of the flow is absent due to the horizontal flushing direction. This results either in incomplete flushing or more water is required for the flushing.

SUMMARY OF THE INVENTION

The object of the invention, therefore, is to specify a sanitary fixture in the form of a WC which is improved relative thereto and which, on the one hand, permits reliable flushing but, on the other hand, is also easy to clean.

To solve this problem, in a sanitary fixture of the type mentioned in the introduction it is provided according to the invention that the water chamber extends only in a rear rim region and that in addition to the first flushing opening at least one second flushing opening is provided, said flushing opening being oriented toward the front, permitting a tangential flushing of the water into the pan region and being able to be supplied with flushing water.

In the WC according to the invention, flushing water is supplied in the known manner from the previously known flushing rim with a vertical flow component and also a horizontal flushing, known from rotational flushing, is carried out tangentially to the pan surface for rotational flushing. In order to permit this, the water chamber, viewed from the front face of the WC, extends only in a rear rim region of the pan, wherein the pan is generally designed to be rounded in the front and rear region and on the sides is either straight or curved. The water chamber extends, therefore, only in the rear rounded region and not along the sides and the front region. The water chamber has the at least one first flushing opening, wherein naturally a plurality of such individual openings may be provided so as to be distributed over the length of the water chamber. This region, viewed from the side, is located relatively close to the outflow of the WC. The flushing water now flows via the one or the plurality of first flushing openings vertically downwardly and passes after a short flow path into the outflow region from where the water passes via an elbow pipe to the outflow pipe on the wall side. As a result, the flushing water supplied via the first flushing opening has a vertical flow component, associated with a relatively high inflow speed, since as set forth above the flow path is very short. This vertical flow component is important for rapid submerging of the objects to be flushed away and thus for rapid flushing in the downward direction.

Since, however, the water chamber is only located in the rear region of the pan, as a result the remaining pan rim region may be designed without a chamber, i.e. rimless, so that this region is very easily accessible for cleaning purposes. In order to flush out this region, in addition to the at least one first flushing opening, at least one second flushing opening is provided, said second flushing opening being oriented toward the front, permitting a tangential flushing of the water into the pan region and also being supplied with flushing water. This second flushing opening thus permits a rotational flushing in the remaining pan region. The water flowing in via the second flushing opening is preferably flushed into the region of a pan side and effectively flows from there on a circular path and rotates downwardly toward the outflow. This rotational flushing permits a very effective flushing of the side and front pan regions and provides the quantity of water which is additionally required in order to flush down the objects to be flushed away, in combination with the quantity of flushing water which is supplied via the one or more first flushing openings and which provides the required vertical component.

The WC according to the invention, therefore, is characterized, on the one hand, by a very effective flushing action since two different flushing techniques are advantageously combined together and the respective regions, where the different flushing techniques are used, are correspondingly adapted to one another, since the "conventional" chamber flushing with a downwardly oriented flow takes place only in the rear region closely adjacent to the outflow, whilst the side and front pan regions are served via the rotational flushing. Moreover, due to the rimless design of the upper pan rim in the widest part, i.e. without an inwardly protruding rim, a very effective cleanability is provided.

In an expedient embodiment, the first and the second flushing opening may be fed together with flushing water from the water chamber. As a result, the water chamber forms the central distribution reservoir into which the flushing water is initially introduced and from where it is distributed toward the corresponding flushing openings. Alternatively, there is the option that a separate connecting portion is provided for supplying the flushing water to the second flushing opening. In other words, according to this alternative a first connecting portion is provided for supplying the flushing water to the first flushing opening(s) and a second connecting portion is provided for supplying the flushing water to the second flushing opening for the rotational flushing.

In both alternatives, it is possible to supply the flushing water in a simple manner. If the flushing water is conventionally supplied from a water tank, with just one common connecting portion the water may be supplied easily to the first and second flushing openings, and only one flushing water supply pipe is required therefor. However, if two separate connecting portions are provided, only one pipe branching has to be provided, so that the water is guided from the water tank to both connectors. The same applies when the flushing water is supplied at significantly higher pressure by using a pressure generating apparatus, in particular a pump. If only one common connecting portion is provided, the pump or the like, respectively the flushing water supply pipe connected thereto, is respectively connected to the one common connector. If separate connectors are provided, a pipe branching is also provided here, wherein in this case there is also the option that a switchable valve apparatus is provided via which it is possible to control which of the pipe branches is supplied, and when and how much flushing water is supplied, so that in this case it is even possible to control the flushing water.

According to an expedient development, it is provided that the second flushing opening discharges into a water guide portion which at least partially runs around the pan region, which is open to the side of the pan region and which is configured on the body. A water guide portion, which serves to hold the exiting flushing water as long as possible in the upper pan region and to guide it as far as possible around the pan, is adjoined to the second flushing opening. The water guide portion is formed, for example, via a horizontally protruding shoulder which provides a water flow surface along which the water flows. The water, which flows in, naturally also flows continuously downwardly over the course of the flow path so that the entire pan surface is flushed out. Via the water guide portion, which permits a guidance of a portion of the flushing water around the pan, it is ensured at the same time that the flushing water also passes into more remote pan regions.

The water guide portion is preferably delimited on the upper face by a projection which is oriented toward the interior of the pan region, and on the lower face by a shoulder on the pan side. The projection on the upper face which is preferably formed via the upper rim of the pan region, which is extended toward the interior of the pan region and which for example protrudes by ca. 1 cm, delimits the water guide portion upwardly and prevents the formation of spray when the flushing water flows through the channel. On the lower face a peripheral shoulder, which is for example also has a width of ca. 1 cm, is provided so that ultimately the water guide portion is effectively slightly recessed into the pan surface. Since on the upper face, as set forth above, there is no rim but only the narrow peripheral projection, the entire channel region is very easily accessible for cleaning purposes.

The water guide portion preferably extends by at least 180° relative to the opposing side of the pan region. The second flushing opening is located in the rear region of one of the side walls, so that if the water guide portion extends by at least 180° relative to the opposing side it is ensured that a sufficient volume of flushing water also arrives on the opposing side and may flow away at that point. Preferably, the water guide portion, which effectively starts on one side of the water chamber, may also extend as far as the other side of the water chamber or even slightly below the water chamber. This makes it possible to hold and to circulate a specific flushing water component for an even greater length of time and at a sufficient height level, even though naturally, as set forth above, in some cases the flushing water also flows away downwardly continuously over the entire channel length.

It is also conceivable that the horizontal depth of the water guide portion reduces toward the end. In other words, the downwardly delimiting shoulder becomes narrower and thus the rim is reduced, so that in this region barely any dirt collects, which as described above may be removed in any case without difficulty. The upper projection, however, circulates fully for visual reasons.

Preferably, a connecting opening of the connecting portion, a supply pipe coming from a pressure increasing apparatus, for example a pump, being connected to said connecting opening, is arranged offset to the side relative to the vertical longitudinal central plane of the body, as is the second flushing opening which is offset to the same side. The supply pipe coming from the pressure increasing apparatus, for example the pump, is thus connected eccentrically and therefore located relatively close to the second flushing opening so that this second flushing opening is supplied rapidly and sufficiently with water. Preferably, both are offset as far as possible toward one of the side regions.

An expedient development of the invention provides that the second flushing opening is provided in the axial extension of a connecting opening of the connecting portion. The flushing water, which is to be supplied to the second flushing opening, is supplied at this connecting opening, wherein depending on the design then the water chamber is flooded only via this one connecting opening. If, however, a separate connecting portion is provided for filling the water chamber, only the second flushing opening is supplied via this connecting opening. In any case, the second flushing opening is located in an axial extension of the connecting opening, so that flushing water supplied via this connecting opening may flow almost directly into the second flushing opening. If the water chamber is also filled via this connecting opening, due to this effectively adjacent arrangement of the second flushing opening, according to the invention it is possible to start the rotational flushing at a very early stage, even before the water chamber is completely filled and the conventional flushing starts in the rear region. "Axial extension" means in this connection that the two openings do not have to be fully aligned with one another, i.e. their centers do not necessarily have to be, but they may be, located on a common line. Instead the two openings may also be arranged slightly laterally offset to one another. In any case, however, the connecting opening is congruent, at least partially but as far as possible substantially, with the second flushing opening, with a small axial spacing as far as possible, such that the water flowing in via the pressure increasing apparatus, such as a pump, at sufficiently high pressure passes as directly as possible from the connecting opening to the second flushing opening and may flow out at sufficiently high pressure at that point. The axial spacing between the two openings should, if possible, only be a few centimeters, preferably between 5-15 cm, preferably between 5-12 cm, and in particular between 5-10 cm. The lateral offset (relative to the respective centers of the openings) should also if possible be as small as possible and preferably be a maximum of 5 cm, preferably a maximum of 3 cm, i.e. a congruence which is as great as possible should be provided. Ideally and preferably the two openings are aligned with one another. Within the specified intervals and/or ranges all of the numerical values to one decimal place are regarded as essential to the invention and are appropriately disclosed for limiting the interval or range.

Preferably, the second flushing opening is adjacent to a side wall of the pan region and the connecting opening is correspondingly laterally offset relative to the vertical longitudinal central plane of the body. Both openings are located, therefore, in the region of a pan side wall, so that the flushing water flows in tangentially in the side region of the pan and at the same time a very short flow path is provided from the supply point, i.e. the connecting opening, to the second flushing opening.

In this case the diameter of the second flushing opening may be smaller than the diameter of the connecting opening. This makes it possible to insert a suitable pipe connector with a corresponding diameter into the connecting opening, so that sufficient water may also flow in thereby and at a sufficiently high pressure when the water is supplied via a pressure increasing apparatus, for example a membrane pressure accumulator or a pump. Since the connecting piece has a slightly smaller diameter compared with the diameter of the connecting opening, as a result the diameter or the cross-sectional surface of the second flushing opening virtually corresponds to the diameter or the cross-sectional surface of the pipe connector itself, so that the flushing water flows out at almost the same pressure.

According to an expedient development of the invention, the water chamber, which is provided only in the rear region of the body, preferably extends over the same width on both sides, relative to the vertical longitudinal central plane of the body, preferably as far as the vicinity of the two side walls or side regions of the pan region. In other words, effectively a symmetrical water chamber and thus a symmetrical chamber volume is provided so that effectively a symmetrical flushing in the rear pan region is possible. Thus the one or generally the plurality of flushing openings are arranged so as to be distributed on both sides relative to the longitudinal central plane, so that also the rear region may be effectively flushed over a large surface area. Due to the rounded design of the pan region in the rear portion, when forming a plurality of first flushing openings these flushing openings are expediently arranged in an arcuate row. Alternatively, an elongated arcuate opening which effectively extends over the entire flushing width is also conceivable. In the case of a plurality of flushing openings these may preferably be designed as circular holes which are stamped out in the production process, wherein however elongated, short slit-like openings are also conceivable.

As described above, in addition to the conventional gravity-fed flushing in which the water is supplied from a water tank, there is also the option to supply the flushing water with greater pressure by means of a pressure increasing apparatus, for example a pump. If such a pressure increasing apparatus and/or pump is used, there is also the option to assist the flushing out process by a so-called "jet". In this case, via a further second flushing water supply pipe, which is supplied via the pressure increasing apparatus and/or the pump, flushing water is flushed from the front directly into the outflow. As a result, this flushing introduces flushing water at a sufficient pressure with a horizontal flow component directly into the outflow region so that the water and the objects located there are forced in the direction of the rear outlet. In order to implement this, according to an expedient development, a further connecting portion with a further connecting opening is provided for a further flushing water supply pipe which is supplied via a pressure increasing apparatus, in particular a pump, wherein a channel runs off from the connecting opening, said channel coming from the front discharging in an outflow channel running off at the lower end of the pan region and running toward the rear face of the body. The further flushing water supply pipe is connected to the pressure increasing apparatus, for example the pump, and supplied thereby, and at the other end it is fastened to the connecting opening on the body. From there a corresponding channel, which is configured on the body side, runs off and discharges in the outflow in the lower pan region.

If such a "jet" is used, accordingly three different flushing techniques are particularly advantageously combined, namely firstly the "conventional" flushing provided only in the rear region with flushing water flowing down vertically, in addition the rotational flushing implemented by the tangential flushing in the lateral and front pan regions, and the jet flushing which actively assists the flushing away process directly in the outflow region. Since in this case a pressure increasing apparatus, for example a pump, is provided, accordingly flushing may be carried out at sufficiently high pressure, which leads to an optimal flushing result.

In order to be able to connect the corresponding flushing water supply pipes in a simple manner, a connecting piece, to which the respective flushing water supply pipe may be fastened, is fastened to the first connecting portion and/or to the further connecting portion, in particular is sealingly bonded into the first and/or the second connecting opening. Generally metal components are used as connecting pieces.

Moreover, a water guide pipe, which extends from the connecting opening to the second flushing opening and which optionally comprises at least one lateral opening permitting a water outlet to the water chamber, may be provided. A formation of spray when the water exits from the second flushing opening may be avoided via this water guide pipe, and at the same time a rapid and direct supply of water from the connecting opening to the second flushing opening is ensured. If the water chamber is flooded via the connecting opening, the second flushing opening also being supplied thereby with water, the water may flow out of the water guide pipe via the lateral opening into the water chamber. If the water guide pipe also has a resilient central portion, it is also possible to compensate for a lateral offset when the connecting and flushing openings are not aligned.

In addition to the sanitary fixture, the invention further relates to a sanitary assembly comprising a sanitary fixture of the described type and a flushing water supply apparatus with a pressure increasing apparatus, in particular a pump, and a first flushing water supply pipe and optionally a further flushing water supply pipe coupled thereto, which are connected or connectable to the first and optionally to the further connecting portion. The sanitary fixture may be a suspended or floor-mounted WC.

The flushing water supply apparatus may also expediently comprise a control apparatus and a valve apparatus which is controllable thereby, wherein the flushing water may be supplied to the first and/or to the at least one further flushing water supply pipe via the valve apparatus. Accordingly, the flushing water supply pipe to the water chamber or to the jet is controlled by the valve apparatus, so that a supply which is clocked and/or variable in terms of quantity is possible. For example, flushing may be initially carried out via the conventional and the rotational flushing until a higher water level is provided in the pan region, whereupon these flushings may be stopped and the jet flushing started. In a third step, therefore, after the jet flushing is finished, a final flushing may be briefly carried out.

Similarly, via this control apparatus in combination with the valve apparatus, but also with a separate supply of the water chamber and the rotational flushing via separate flushing water supply pipes, a supply which is clocked or controlled in terms of the flushing water quantity is possible, so that in this case even three separate flushing steps (conventional, rotational, jet) may be individually controlled.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
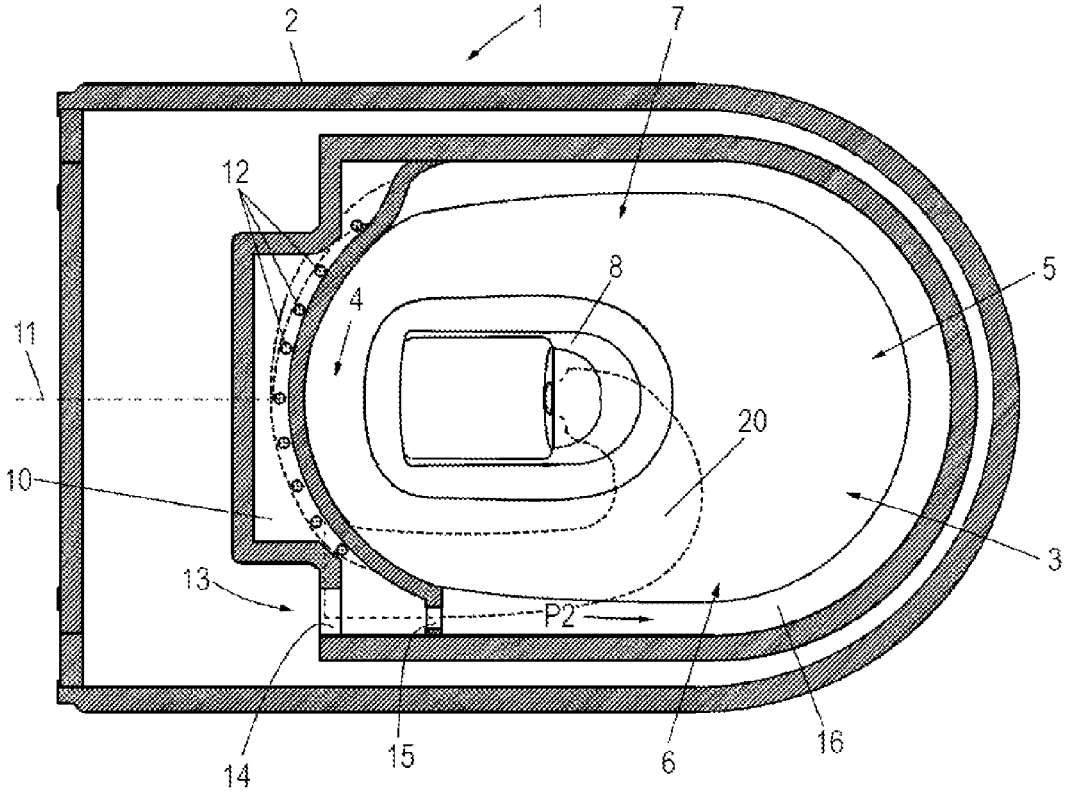
FIG. 1 shows a schematic view, in horizontal section, of a sanitary fixture according to the invention in the form of a WC according to a first embodiment.

FIG. 1 shows a sanitary fixture 1 according to the invention in the form of a WC comprising a body 2, conventionally made of a ceramic material, which is preferably produced in a hollow casting. The body 2 has a pan region 3 which is upwardly open, see also the vertical section according to FIG. 2 relative thereto. The pan region has a rear region 4, a front region 5 and two side regions 6, 7. The pan region 3 discharges in an outflow 8 which, see FIG. 2, terminates in a rear outflow connecting piece 9, which in the manner known per se extends upwardly and to which an outflow pipe is connected.

The WC according to the invention has a water chamber 10 which as is visible, see FIG. 1, is provided only in the rear region 4 and extends on both sides of a vertical longitudinal central plane 11. Relative to this longitudinal central plane 11 the chamber volume and the chamber geometry are virtually equal on both sides, i.e. a symmetrical chamber construction is provided.

Figure 2:
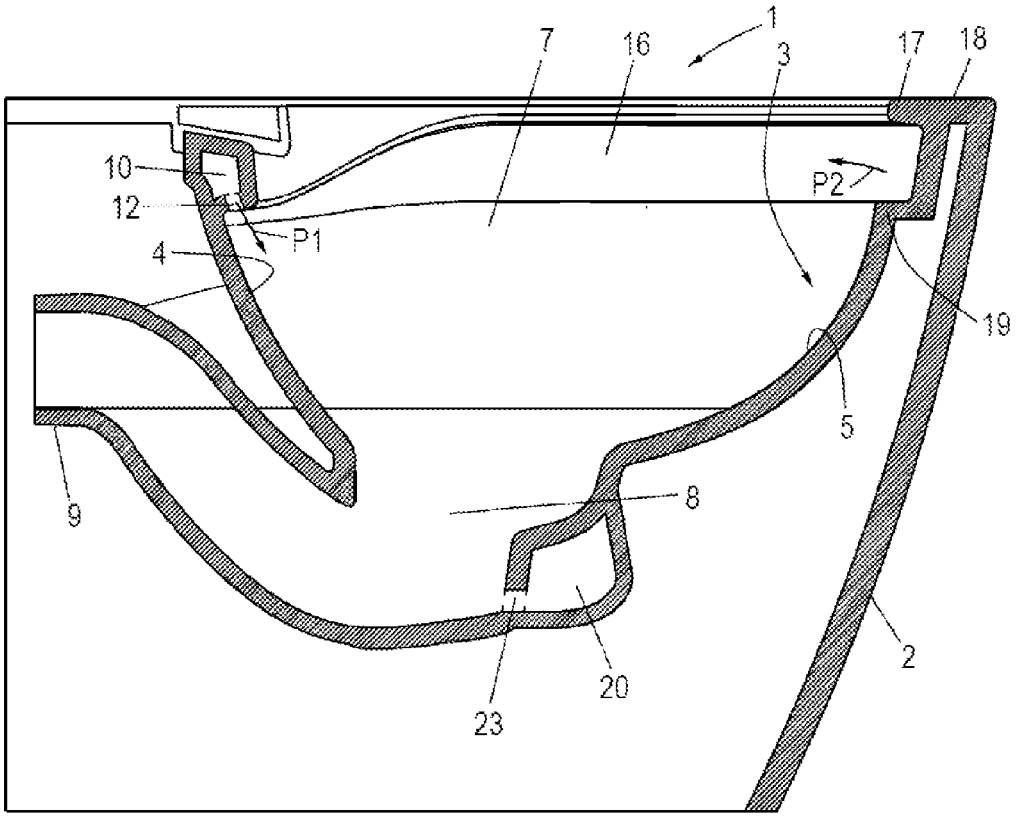
FIG. 2 shows the WC of FIG. 1 in vertical section.

The water chamber extends, see FIG. 2, toward the interior of the pan region 3, i.e. protrudes on the rim side. On the lower face of this protruding region the water chamber 10 is provided with a plurality of first flushing openings 12, see in particular FIG. 1, which are arranged in an arcuate manner corresponding to the rounded geometry of the pan region 3.

The water chamber 10 also has a first connecting portion 13 with a connecting opening 14 into which a connecting piece which is made of metal or consists of plastics is sealingly bonded, in order to connect a flushing water supply pipe thereto. The water chamber 10 is supplied with flushing water via this connecting opening 14 so that via the first flushing openings 12 the water, as shown in FIG. 2 by the arrow P1, flows down vertically and with a short flow path directly into the region of the outflow 8.

A second flushing opening 15 is provided in an axial extension to the laterally provided connecting opening 14, said second flushing opening also being supplied with flushing water via the water chamber 10. This second flushing opening 15 permits a horizontal and tangential flushing of the flushing water along the pan surface, starting in the side region 6. The tangential flow is indicated by the arrow P2. A rotational flushing is formed thereby, since the horizontally and tangentially flushed flushing water circulates around the pan with this primary flow direction, i.e. from the side region 6 into the front region 5 and from there into the opposing side region 7. Parallel to this effectively rotational flow, naturally a part of the flushed water also flows downwardly so that the entire side and front pan region is flushed thereby.

A water guide portion 16 is provided in order to keep the flushing water, which is flushed in via the second flushing opening 15, as long as possible in the upper rim region, said water guide portion being configured on the body 2, as FIGS. 1 and 2 show, and starting from the second flushing opening 15 circulating around the lateral region 6, the front region 5 and the opposing lateral region 7 and extending to the other side of the water chamber 10, optionally running slightly below this water chamber. The water guide portion is formed, for example, via a horizontally projecting shoulder which provides a water running surface along which the water flows. This water guide portion 16 on the upper face is encompassed by a short inwardly oriented projection 17 of the upper rim 18 of the pan region 3, any outward overspray being avoided by said projection 17. Downwardly, the water guide portion 16 is defined by a peripheral shoulder 19 configured on the body, see FIG. 2, so that effectively a water guide portion 16, which is recessed in the pan wall in which the flushing water is guided, is formed. Thus a defined water guide surface is provided via the water guide portion 16 in order to circulate the flushing water as far as possible, wherein due to the supplied quantity of water during the circulating flow a sufficient quantity of water naturally also runs downwardly in order to flush the entire pan surface.

Whilst in the examples shown the water guide portion 16 circulates fully, it is also conceivable to permit the water guide portion 16 to circulate only by ca. 180° or the like, thus not to extend over the entire opposing side surface 7 but to terminate in the region thereof or shortly in front of said region. Similarly the horizontal depth of the water guide portion 16 may also taper toward its end, i.e. the shoulder 19 becomes narrower and tapers off toward the end.

The supply of the first and second flushing openings 12, 15 is carried out via the common water chamber 10 which is supplied with flushing water via the connecting opening 14. This is expediently carried out via a pressure increasing apparatus, in particular a pump, which conveys the flushing water at sufficiently high pressure into the water chamber 10. In principle, however, purely gravity-fed flushing might also be conceivable.

Since the second flushing opening 15 is arranged in the axial extension and very closely adjacent to the connecting opening 14, when the flushing process starts, before the water chamber 10 is completely filled, the water flowing in is discharged via the second flushing opening 15, i.e. the rotational flushing starts, and in terms of chronology even slightly before the conventional flushing on the rear face via the first flushing openings 12.

Figure 5:
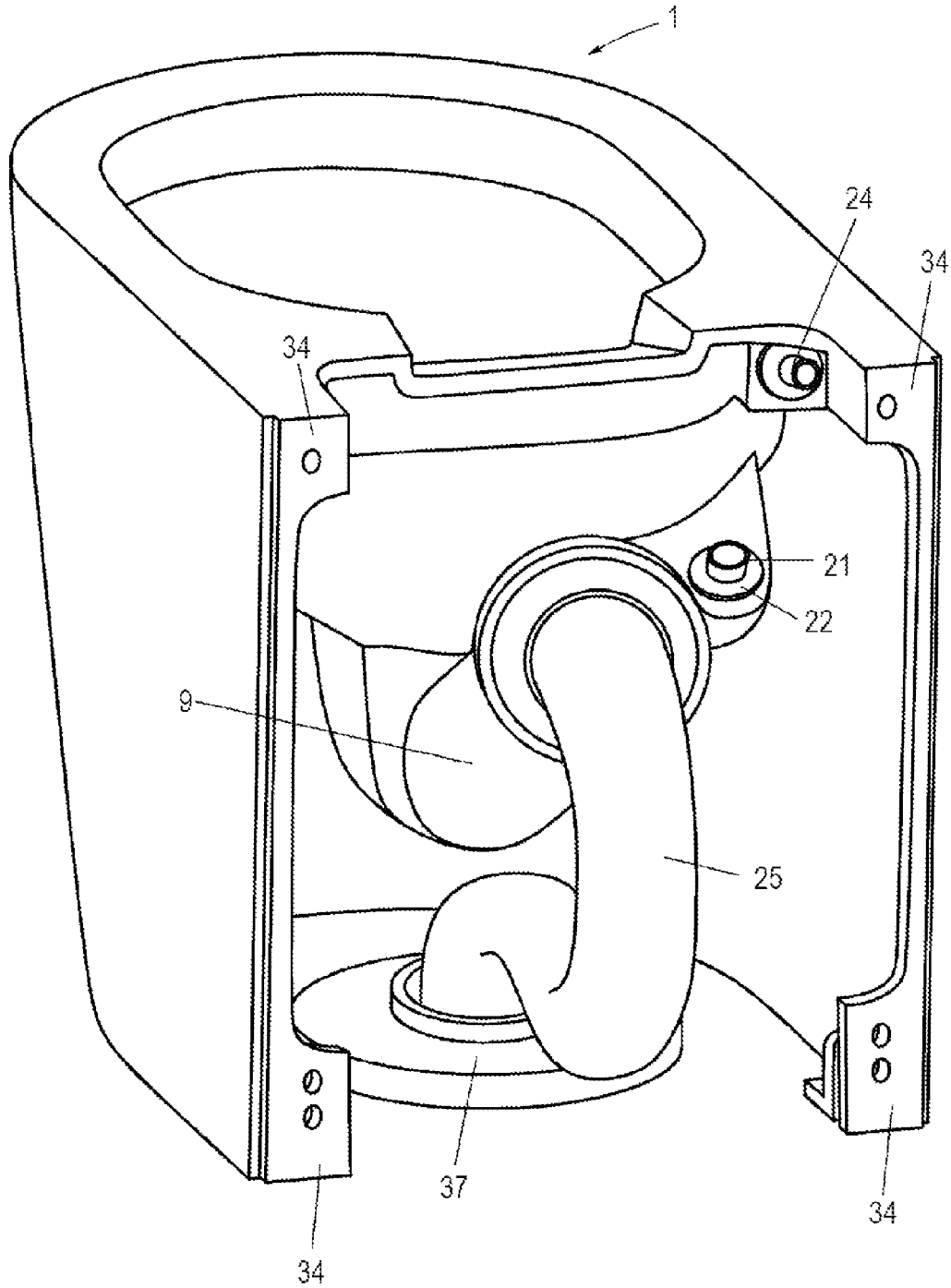
FIG. 5 shows a perspective rear side view of the WC of FIG. 3.

Also provided is a channel 20 which is configured in the body and which, see FIG. 5, is supplied with flushing water via a rear connecting opening 21, into which a connecting piece 22 which is made of metal or consists of plastics is introduced, and which discharges in the outflow 8 in an arcuate manner from the front face and communicates therewith via a corresponding opening 23. A so-called "jet" is formed thereby. The flushing water supplied via the channel 20 is introduced at sufficiently high pressure via the pressure increasing apparatus, in particular the pump, and flows directly into the outflow region, i.e. forces the water located therein, respectively the objects located therein, in the direction toward the rear outflow connecting piece 9 so that the discharge is actively assisted thereby and not only takes place via the flushing water flowing in from above.

Figure 3:
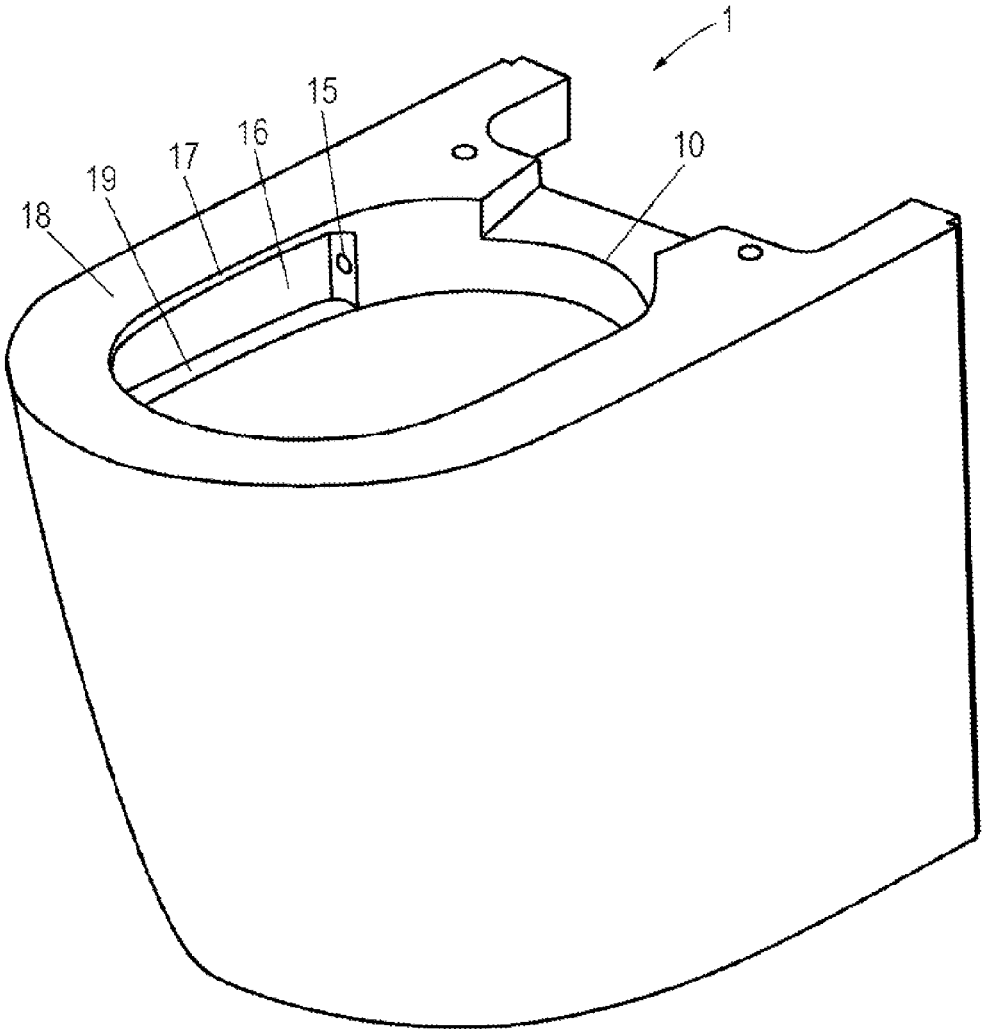
FIG. 3 shows such a WC in a perspective view.
Figure 4:
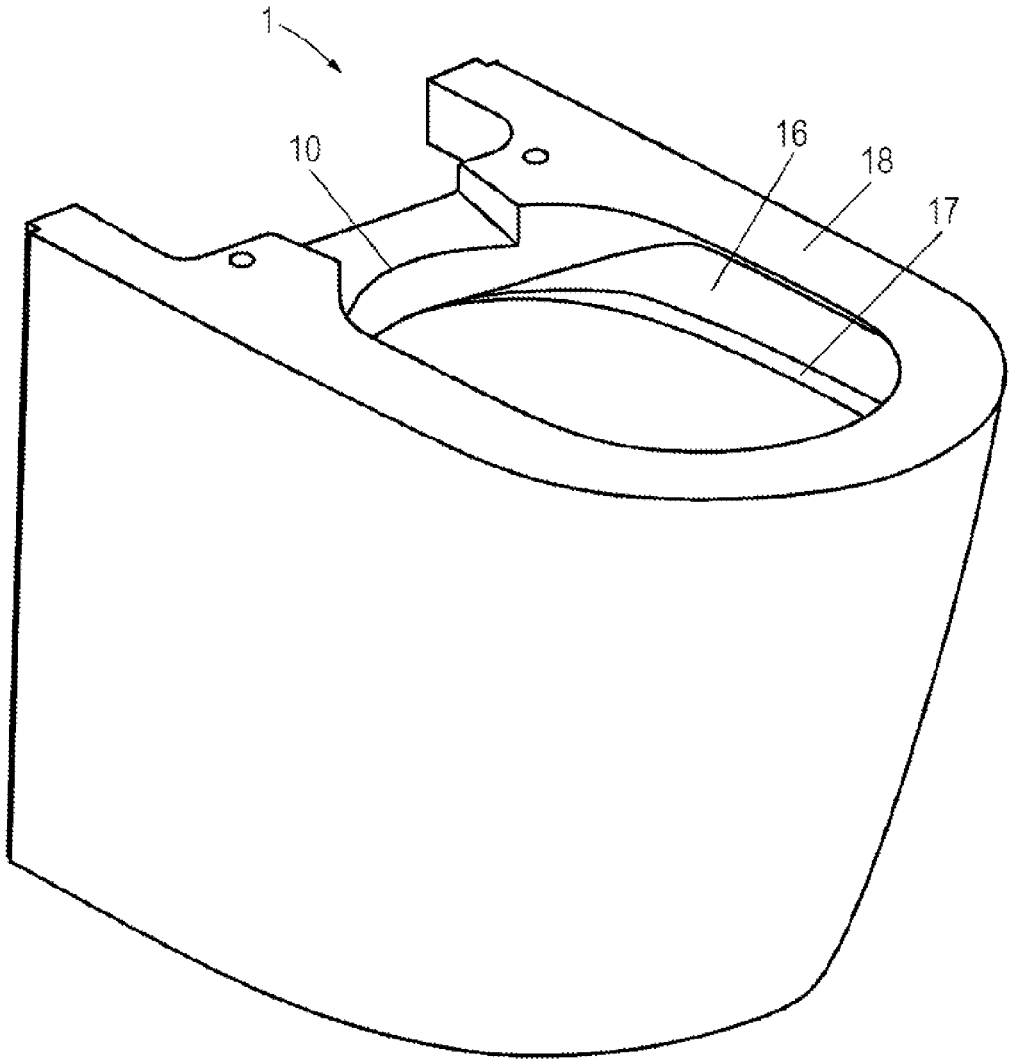
FIG. 4 shows the WC of FIG. 3 in a perspective view from the other side.

FIGS. 3 and 4 show two perspective views of the sanitary fixture 1 according to the invention, respectively the WC. FIG. 3 shows the second flushing opening 15 and the water guide portion 16 connected thereto with the projection 17 encompassing said water guide portion on the upper face, as well as the shoulder 19 on the lower face. Also shown is the water chamber 10 which is configured in the rear region.

The perspective view according to FIG. 4 shows the opposing side with the water guide portion 16 guided further therein, in addition to the projection 17 and shoulder 19. It may be seen that the water guide portion 16 extends as far as and/or slightly below the water chamber 10. A second flushing opening is not provided there, i.e. flushing is carried out only from the opposing side.

FIG. 5 shows a rear view of the WC. As described, firstly the connecting piece 22 with the connecting opening 21, which leads to the channel 20 for the jet flushing, is shown here. Secondly, a connecting piece 24 which is sealingly bonded into the connecting opening 14 and via which the flushing water is guided into the water chamber 10 is shown.

Moreover, an elbow pipe 25 is connected to the outflow connecting piece 9, said elbow pipe leading to an outflow connector 37 on the lower face which is connected to the waste water pipe on the building side. This elbow pipe 25 is preferably a plastics pipe.

Figure 6:
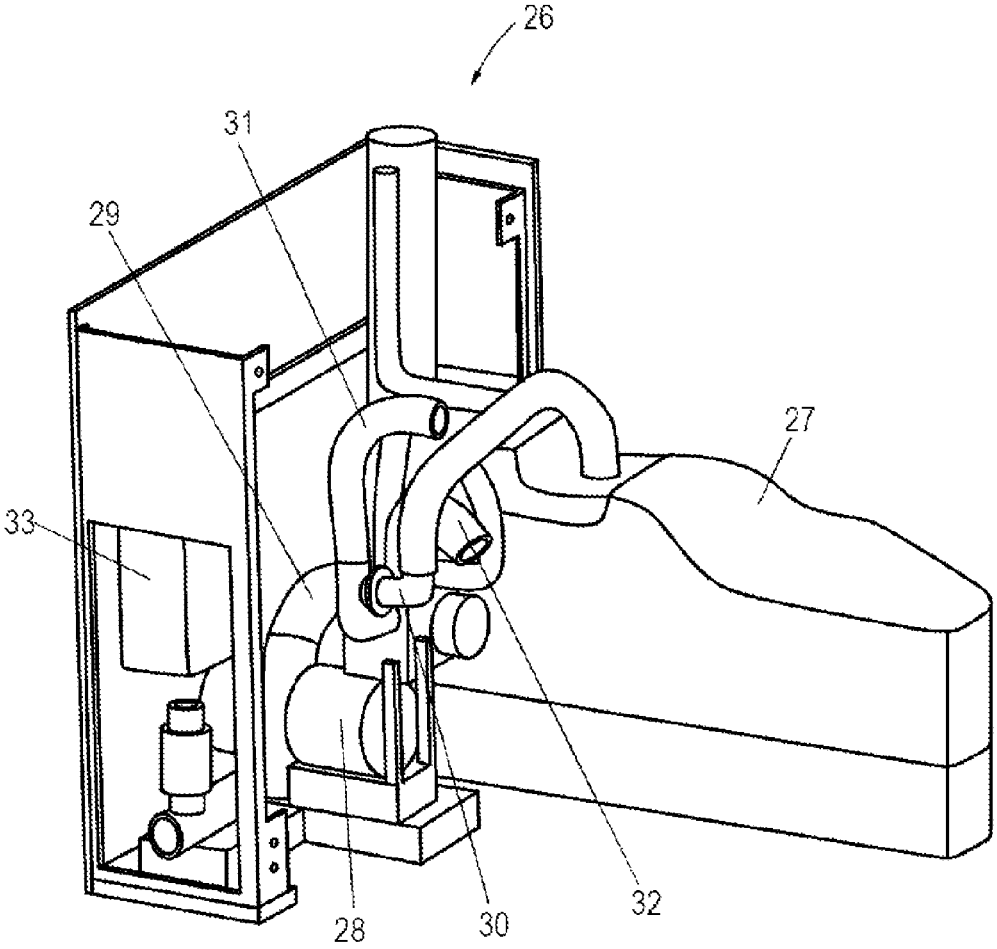
FIG. 6 shows a perspective view in the form of a schematic view of a flushing water supply apparatus for a WC according to FIG. 3.

As described, in the present case a pressure increasing apparatus, preferably in the form of a pump, is used, said pressure increasing apparatus being part of a flushing water supply apparatus 26, shown in FIG. 6 as a schematic view. This flushing water supply apparatus comprises, on the one hand, a tank 27 which is filled via a water connector on the building side via a valve, which is switched as a function of the filling state. Also provided is a pump 28 which is coupled via a connecting pipe 29 to the tank 27. Coupled to the pump 28 is a valve apparatus 30 to which a first flushing water supply pipe 31 is connected, said first flushing water supply pipe being connected to the connecting piece 24 for filling the water chamber 10. A further flushing water supply pipe 32, which is connected to the connecting piece 22 for the jet flushing, is provided.

Also provided is a control apparatus 33 which, on the one hand, controls the operation of the pump 28 and, on the other hand, the valve apparatus 30, so that a lateral flow of the various types of flushing may be controlled in a defined manner.

The flushing water supply apparatus 26 is inserted from the rear face into the body 2 and may be fastened thereto at corresponding fastening portions 34. The tank 27, viewed on the basis of FIG. 5, passes to the left of the elbow pipe 25 of the assembly, and the other components are accordingly distributed in the remaining space of the body 2.

Thus, for example, when flushing is to be carried out after using the WC, the flushing is controlled such that initially the water chamber 10 is supplied with flushing water and the flushing water is flushed via the flushing openings 12 and 15 into the pan region. During this process or after the end of the process, the jet flushing is then switched on at a specific time, i.e. the water is supplied for a specific time to the channel 20 in order to force the water into the outflow 8 and to flush out this outflow. After this jet flushing is finished, for example, a further flushing of the pan region may be carried out via the flushing openings 12, 15.

Both regarding the chronological sequence and the duration and also the quantity of the respectively supplied flushing water, a sufficient freedom exists regarding the actual design of the control system.

The combination according to the invention of conventional flushing in the rear region via the flushing openings 12 with the rotational flushing via the flushing opening 15 and the additional jet flushing, permits an optimal flushing result. Firstly, the flushing water is supplied via the first flushing openings 12 with a direct vertical flow component so that objects located in the region of the outflow are reliably submerged thereby and forced downwardly. By the rotational flushing via the second flushing opening 15, an effective flushing of the lateral and front pan regions is achieved so that via both types of flushing the entire pan region is very effectively flushed out, but at the same time the vertical flow component required for the submerging is also provided. Via the jet flushing, the actual flushing out process, which has already been initiated by the flushing water flowing in via the flushing openings 12 and 15, is actively assisted further.

As the flushing water is supplied via a pump 28, the flushing out of the pan region 3 is also achieved at a sufficiently high water pressure that both the vertical flow and the rotational flow are sufficiently strong.

Figure 7:
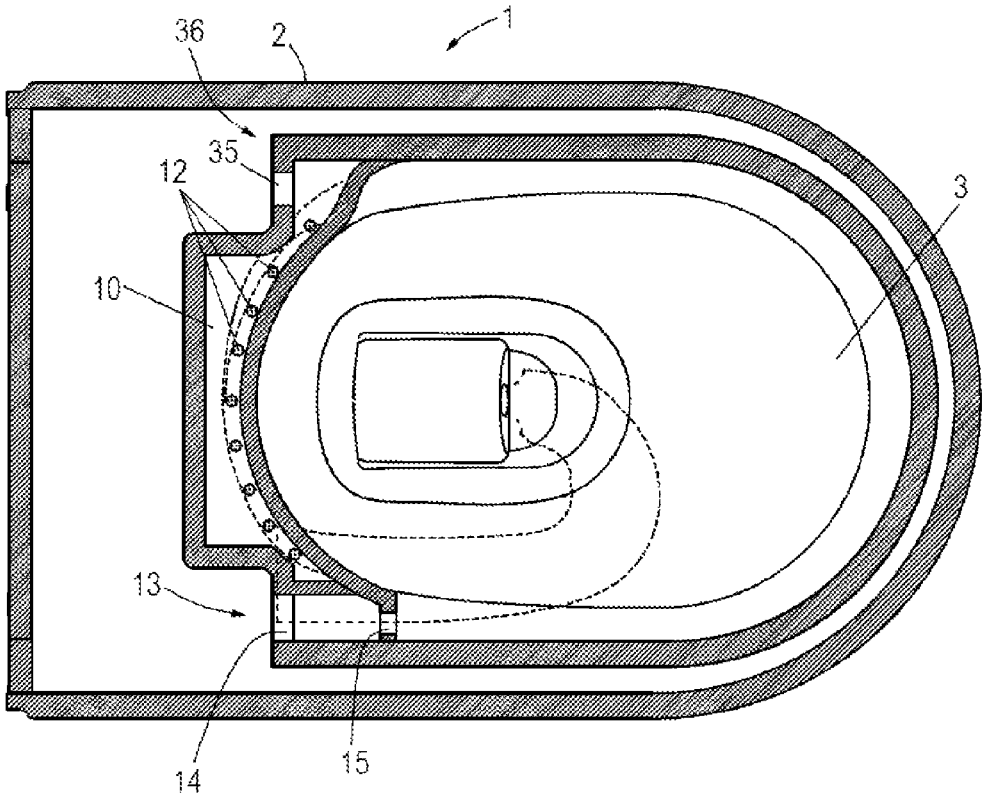
FIG. 7 shows a schematic view, in horizontal section, of a WC of a second embodiment.

FIG. 7 shows a further embodiment of a sanitary fixture 1 according to the invention in the form of a WC, once again comprising a body 2 and a pan region 3. The basic construction of the WC corresponds to that of FIG. 1 which is why reference is made to the embodiments relevant thereto.

A water chamber 10, which protrudes into the pan region 3 and on which a plurality of separate first flushing openings 12 are provided on the lower face, is also provided here. This water chamber 10, however, is supplied with flushing water via a separate connecting opening 35, in turn supplied via a pump 28, for example. A separate flushing water supply pipe passes from the pump 28 to this connecting opening 35. In other words, the conventional flushing via the downwardly oriented first flushing openings 12 may be separately controlled.

The second flushing opening 15 is not supplied with flushing water via the water chamber 10. The connecting opening 14 is provided in a region separate therefrom, and a separate flushing water supply pipe is fastened to this connecting opening 14 in order to supply the required water for the rotational flushing. In other words, the rotational flushing may also be separately controlled.

The flushing water supply apparatus 26 disclosed in FIG. 6 is accordingly complemented by an additional flushing water supply pipe, and the valve apparatus 30 may be designed accordingly. This additional flushing water supply pipe is connected to the connecting opening 35 in order to supply the water chamber 10.

The control apparatus 33 in this case is able to control separately and individually the three separate flushing variants, namely in the conventional manner solely via the water chamber 10, rotational flushing via the second flushing opening 15 and jet flushing via the channel 20, the valve apparatus 30 being correspondingly activated therefor. This permits any operation in a clocked manner and also a correspondingly controlled supply of a quantity of flushing water for the individual flushing variants.

The respective sanitary fixture 1, whichever embodiment, and the respective flushing water supply apparatus 26, whichever embodiment, which is correspondingly designed, together form a sanitary assembly.

Figure 8:
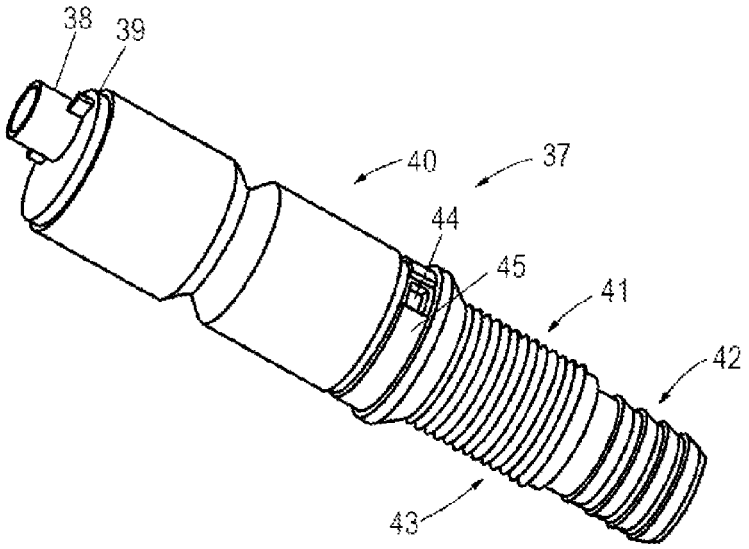
FIG. 8 shows a schematic view of a water guide pipe for inserting into the water chamber.
Figure 9:
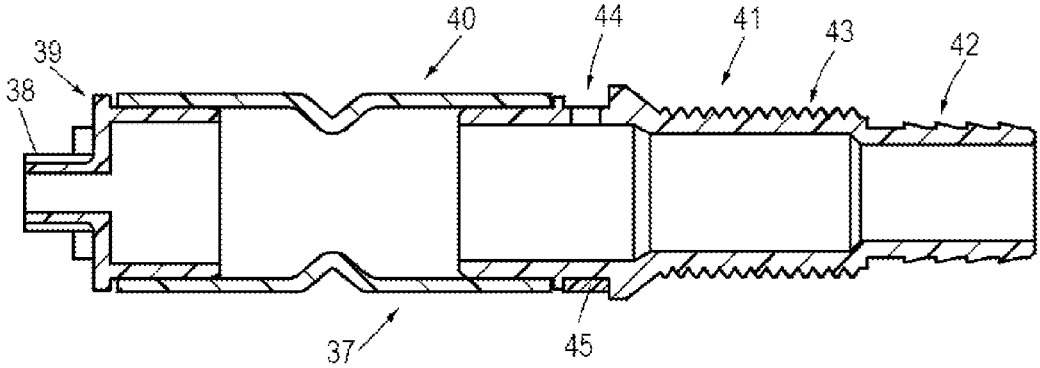
FIG. 9 shows a sectional view of the guide pipe.

FIG. 8 shows a water guide pipe 37 for insertion into the water chamber 10 in the region of the connecting opening 14 and the second flushing opening 15. Said water guide pipe serves, in particular in the case of greater pump pressure and uncontrolled inflow to the opening 15, to prevent the formation of spray when water flows out of the opening 15. The water guide pipe 37, shown in cross section in FIG. 9 and preferably consisting of plastics, is inserted through the connecting opening 14 and introduced into the flushing opening 15 with a hollow pipe connector 38 on the end side which is arranged eccentrically. The pipe connector 38 is configured on a first pipe portion 39.

A second resilient pipe portion 40 is adjoined to the first pipe portion 39 and permits a compensation of the offset when the connecting opening 14 and the flushing opening 15 are not aligned with one another and/or a significant lateral offset is present. Ideally both openings are aligned with one another.

A third pipe portion 41 adjoins this central second pipe portion 40, a fluted portion 42 being provided at the end thereof for connecting a flushing water supply pipe 31. A threaded portion 43 adjoins this fluted portion 42, after introducing the water guide pipe 37 a retainer nut for fixing the water guide pipe 37 being screwed thereon. At least one lateral and/or radial opening 44 is provided on the third pipe portion 40, the position and/or size thereof being adjustable via an adjusting ring 45 rotatably arranged on the pipe outer face. It is also possible to adjust thereby the speed at which the water chamber 10 is filled.

If water is introduced into the water guide pipe 37 via the pump 28, this water flows to the pipe connector 38 and out at that point, so that it passes via the flushing opening 15 into the pan. Since the water flows in a manner which is directed and with little turbulence, spray may be avoided, in particular in the case of greater pump pressure. At the same time, the water also flows out from the opening 44, whereby the water chamber 10 is flooded. As the water is relatively directly guided from the connecting opening via the water guide pipe 37 to the second flushing opening, due to the effectively aligned arrangement of the connecting opening and the second flushing opening, it exits at that point at sufficiently high pressure at a very early stage at the start of the flushing process, whilst the water chamber is still filling up and the water flows out via the first flushing openings with a slight time delay.

The water guide pipe shown may be used in a WC according to FIG. 1, where the flushing opening 15 and the water chamber 10 are controlled via the common inflow via the connecting opening 14. In an embodiment according to FIG. 7, such a water guide pipe may also be used but this does not require an opening 44 or an adjusting ring 45 since the water chamber 10 is flooded via a separate connection.

While specific embodiments of the invention have been shown and described in detail to illustrate the inventive principles, it will be understood that the invention may be embodied otherwise without departing from such principles.

I claim:

1. A sanitary fixture formed as a WC, comprising a body having an upwardly open pan region, a water chamber provided in a region of the upper rim of the pan region and, when viewed horizontally, protrudes into the pan region, wherein at least one first flushing opening oriented downwardly into the pan region is provided on a side of the chamber, and at least one connecting portion provided in a rear region of the body for connecting a flushing water supply pipe for supplying flushing water into the water chamber, the flushing water flowing from the water chamber into the pan region via the at least one flushing opening, wherein the water chamber extends only in a rear rim region and, in addition to the at least one first flushing opening, a second flushing opening is provided, said second flushing opening being oriented to a front of the body, permitting a tangential flushing of the water into the pan region and being able to be supplied with flushing water, wherein a further connecting portion with a further connecting opening is provided for a further flushing water supply pipe supplied via a pressure generating apparatus, wherein a channel runs off from the further connecting opening and discharges in an outlet running off at a lower end of the pan region and running toward a rear face of the body.

2. The sanitary fixture according to claim 1, wherein the first and the second flushing openings are fed together with flushing water from the water chamber or in each case a separate connecting portion of the at least one connecting portion is provided for supplying the flushing water to the first and second flushing things.

3. The sanitary fixture according to claim 1, wherein the second flushing opening discharges into a water guide portion that at least partially runs around the pan region, is open laterally toward the pan region and is configured on the body.

4. The sanitary fixture according to claim 3, wherein the water guide portion is delimited on an upper face by a projection oriented toward an interior of the pan region, and on a lower face by a shoulder on a side of the pan.

5. The sanitary fixture according to claim 4, wherein the projection is formed by the upper rim of the pan region, said upper rim extending toward the interior of the pan region.

6. The sanitary fixture according to claim 3, wherein the water guide portion circulates by at least 180° relative to an opposing side of the pan region.

7. The sanitary fixture according to claim 6, wherein the water guide portion extends as far as an opposite side of the water chamber or below the water chamber.

8. The sanitary fixture according to claim 3, wherein a horizontal depth of the water guide portion reduces toward an end.

9. The sanitary fixture according to claim 1, wherein the second flushing opening is provided in an axial extension of a connecting opening of the connecting portion.

10. The Sanitary fixture according to claim 9, wherein the second flushing opening is adjacent to a side wall of the pan region and the connecting opening is provided correspondingly laterally offset relative to a vertical longitudinal central plane of the body.

11. The sanitary fixture according to claim 9, wherein a diameter or a cross-sectional surface of the second flushing opening is smaller than a diameter or a cross-sectional surface of the connecting opening.

12. The sanitary fixture according to claim 9, wherein a connecting piece to which the flushing water supply pipe is fastenable, is fastened to the first connecting portion and/or to the further connecting portion, in particular is bonded into the first and/or second connecting opening.

13. The sanitary fixture according to claim 12, wherein the connecting piece is bonded into the connecting opening and/or the further connecting opening.

14. The sanitary fixture according to claim 1, wherein the water chamber extends substantially over a common width on both sides relative to a vertical longitudinal central plane of the body.

15. The sanitary fixture according to claim 1, wherein a plurality of first flushing openings are provided so as to be arranged in an arcuate row.

16. The sanitary fixture according to claim 1, further comprising a water guide pipe which extends from the connecting opening to the second flushing opening.

17. The sanitary fixture according to claim 16, wherein the water guide pipe comprises at least one lateral opening permitting a water outlet to the water chamber.

18. A sanitary assembly comprising the sanitary fixture according to claim 1 and a flushing water supply apparatus with a pressure generating apparatus, and a first and at least one further flushing water supply pipe coupled thereto, which are connected or connectable to the first and to the further connecting portion.

19. The sanitary assembly according to claim 18, wherein the flushing water supply apparatus comprises a control apparatus and a valve apparatus that is controllable by the control apparatus, wherein the flushing water is supplied to the first and/or the at least one further flushing water supply pipe via the valve apparatus.

* * * * *